US007226192B2

(12) United States Patent
Chen

(10) Patent No.: US 7,226,192 B2
(45) Date of Patent: Jun. 5, 2007

(54) EXPANDING STRUCTURE OF A LAMP

(75) Inventor: Meiric Chen, Taiwan Hsien (TW)

(73) Assignee: Seed Lighting Design Co., Ltd, Hsinchuang, Taipei (TW)

( * ) Notice: Subject to any disclaimer, the term of this patent is extended or adjusted under 35 U.S.C. 154(b) by 156 days.

(21) Appl. No.: 11/079,509

(22) Filed: Mar. 14, 2005

(65) Prior Publication Data

US 2006/0203501 A1 Sep. 14, 2006

(51) Int. Cl.
*F21V 21/16* (2006.01)

(52) U.S. Cl. ..... 362/405; 362/269; 362/386; 362/407

(58) Field of Classification Search ..... 362/233, 362/250, 269, 272, 275, 286, 287, 289, 386, 362/391, 396, 403, 405, 407, 427, 428
See application file for complete search history.

(56) References Cited

U.S. PATENT DOCUMENTS

| | | | | |
|---|---|---|---|---|
| 1,062,691 A * | 5/1913 | Burke | ..... | 362/403 |
| 1,335,832 A * | 4/1920 | Harvey | ..... | 362/250 |
| 1,631,488 A * | 6/1927 | Jones | ..... | 362/403 |
| 1,668,772 A * | 5/1928 | Kestell | ..... | 362/405 |
| 5,519,597 A * | 5/1996 | Tsai | ..... | 362/386 |

* cited by examiner

*Primary Examiner*—Y. My Quach-Lee

(57) ABSTRACT

An expanding structure of a lamp comprises a seat; a plurality of supporting frames rotatably installed to a periphery of the seat; one end of each supporting frame being connected to the seat and other end of the supporting frame being connected to a respective lamp body; a stand tube extending from an upper end of the seat; a lead passing through an interior of the stand tube; a plurality of adjusting wires extending from a periphery of the stand tube; one end of each adjusting wire being connected to the supporting frame near the lamp body. A ring encloses the stand tube; the ring includes a connecting portion and a clamping portion; the connecting portion encloses around the stand tube. A motor is installed to the retainer. At least one pull wire is installed between the motor and the ring.

3 Claims, 7 Drawing Sheets

EXPANDING STRUCTURE OF A LAMP

FIELD OF THE INVENTION

The present invention relates to ceiling lamps, and in particular to an expanding structure of a lamp, wherein the orientations of the lamp bodies are changeable so as to have a preferred visual effect. Thereby the projection area and the illumination are changeable so as to match the requirement of the environment. Thereby a motor is used to control the orientation of the lamp bodies which makes the control can be performed easily.

BACKGROUND OF THE INVENTION

In the prior art ceiling lamps or stand lamps, the lamp body 10 is installed to one end of a support 11 (referring to FIG. 1). A base 12 is connected to the stand tube 13 so as to be positioned thereto. However the form of the lamp has only one type. Furthermore, the light projection area of the lamp and the illumination thereof is fixed so that it can not be adjusted based on the requirement of the users or the change of environment so as to have preferred vision and hearing effect. Thereby the prior art is necessary to be improved.

SUMMARY OF THE INVENTION

Accordingly, the primary object of the present invention is to provide an expanding structure of a lamp, wherein the orientation of the lamp bodies are changeable so as to have a preferred visual effect. Thereby the projection area and the illumination are changeable so as to match the requirement of the environment. Thereby a motor is used to control the orientation of the lamp bodies which makes the control can be performed easily.

To achieve above objects, the present invention provides an expanding structure of a lamp which comprises a seat; a plurality of supporting frames rotataibly installed to a periphery of the seat; one end of each supporting frame being connected to the seat and other end of the supporting frame being connected to a respective lamp body; a stand tube extending from an upper end of the seat; a lead passing through an interior of the stand tube; a plurality of adjusting wires extending from a periphery of the stand tube; one end of each adjusting wire being connected to the supporting frame near the lamp body. A ring encloses the stand tube. The ring includes a connecting portion and a clamping portion; the connecting portion encloses around the stand tube. A motor is installed to the retainer. At least one pull wire is installed between the motor and the ring.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
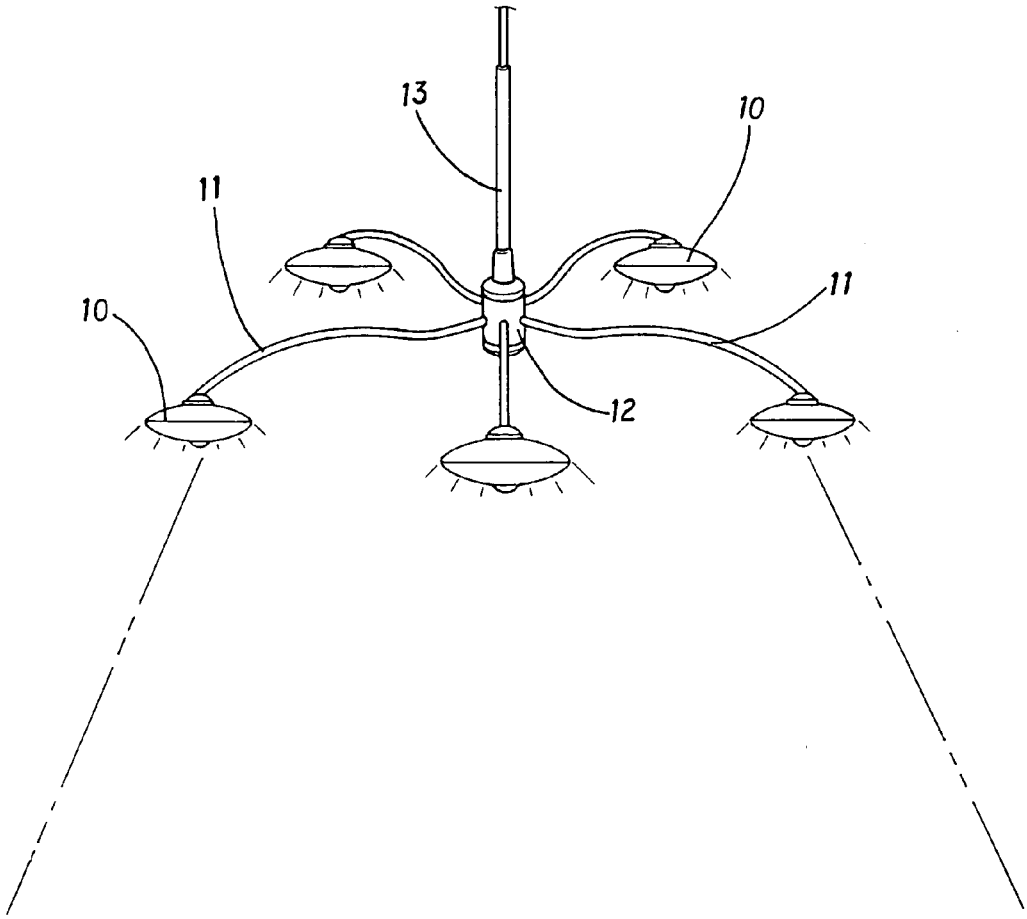
FIG. 1 PRIOR ART
FIG. 1 is a schematic view about the use of the prior art ceiling lamp.
Figure 2:
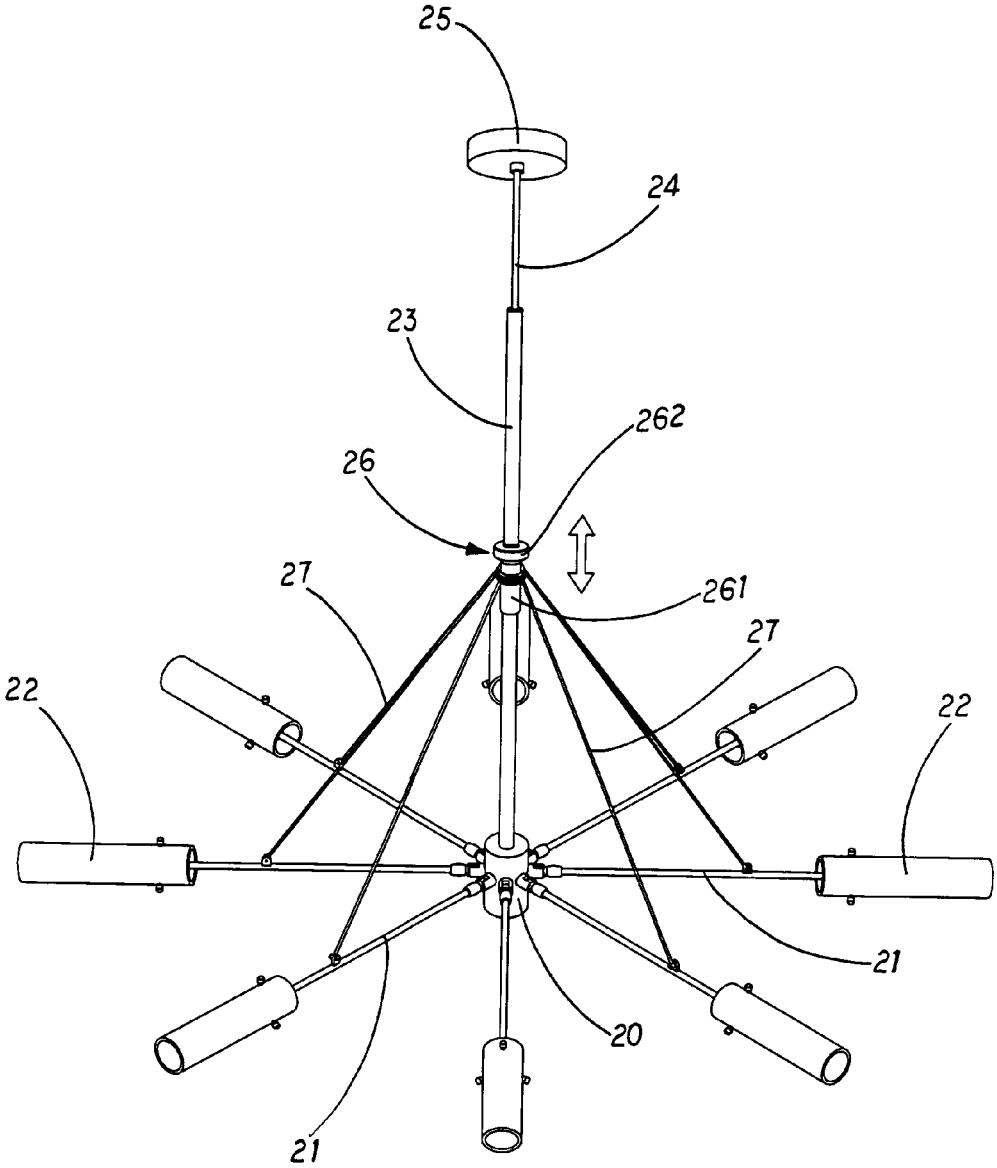
FIG. 2 is a perspective view of the present invention.
Figure 3:
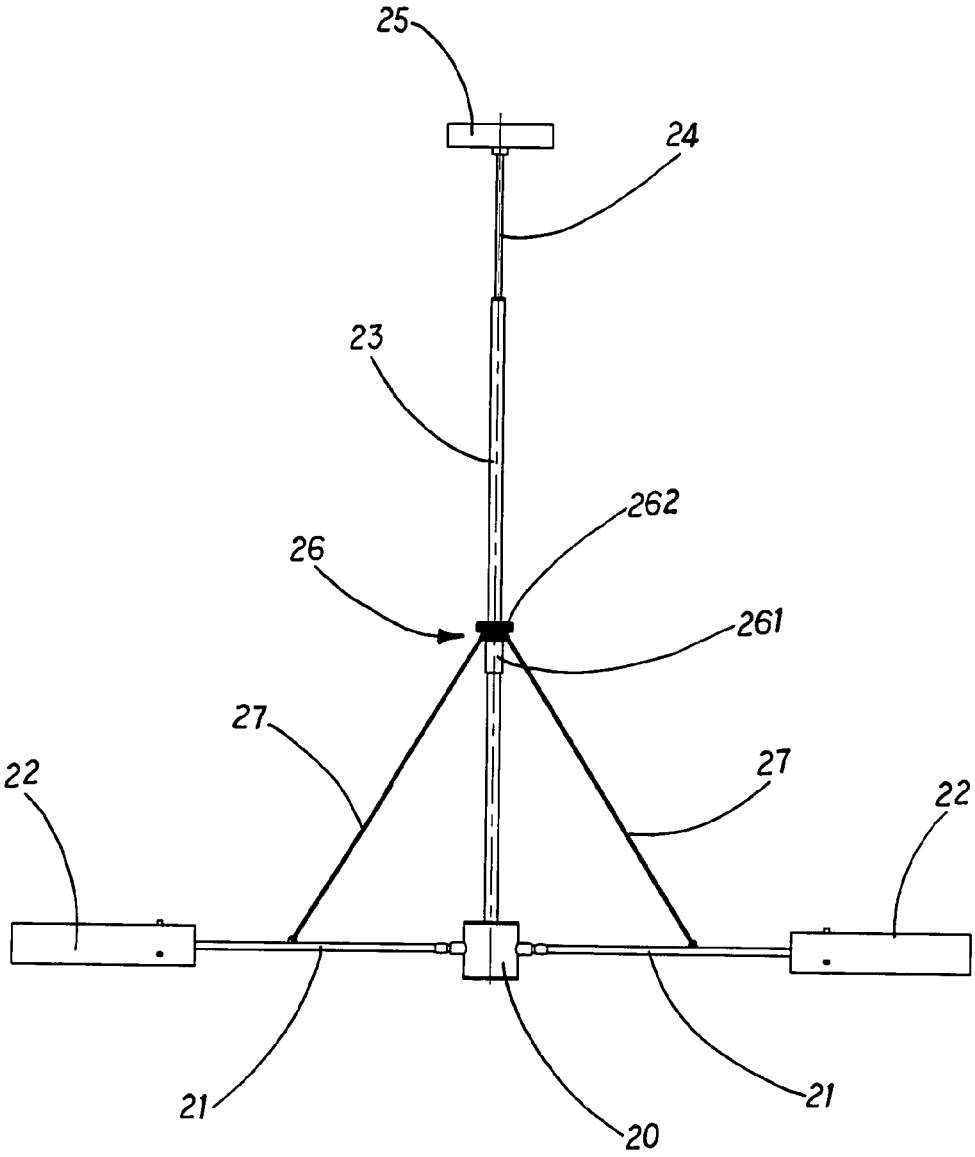
FIG. 3 is a plane view of the present invention.
Figure 4:
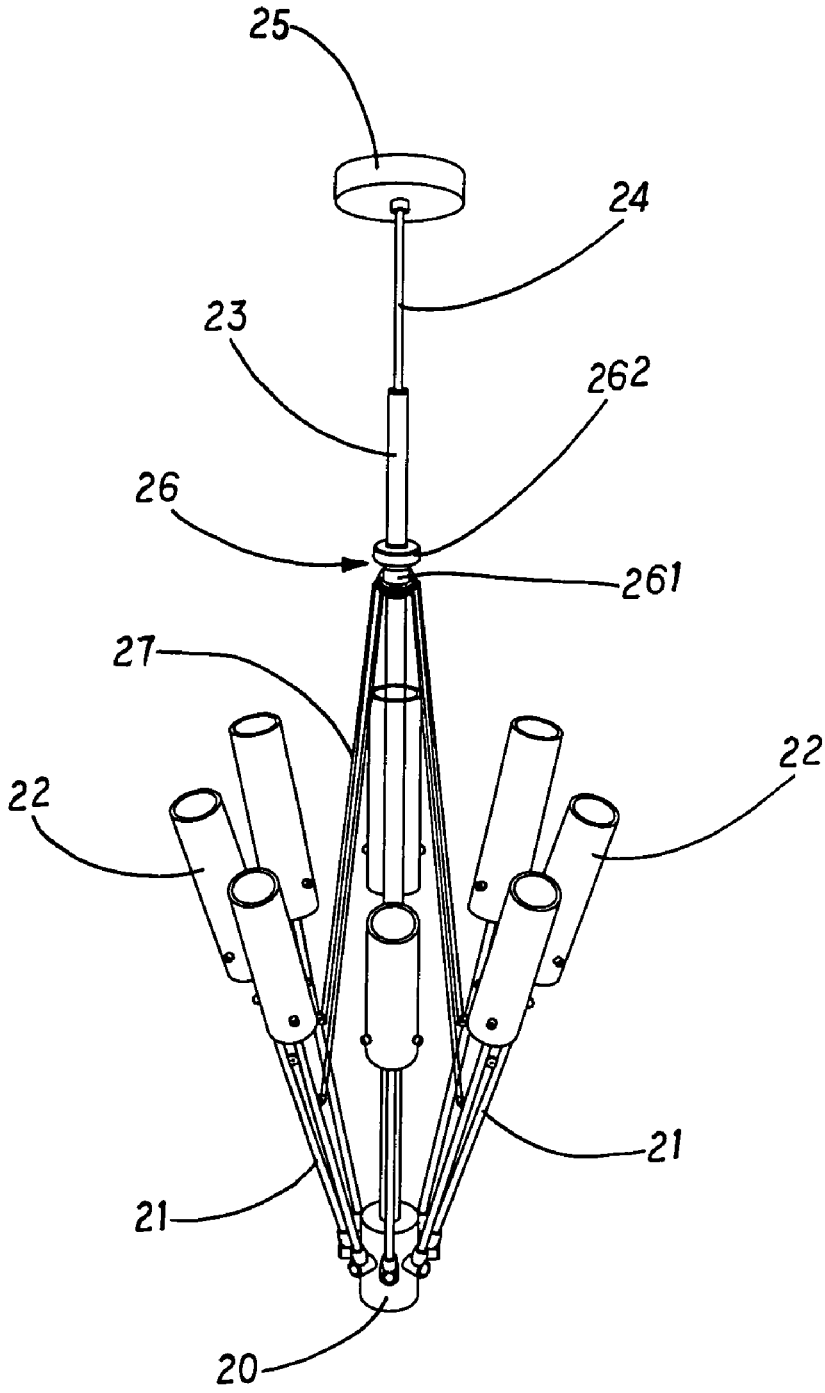
FIG. 4 is a perspective view about the use of the present invention.

Referring to FIGS. 2 to 4, the structure of the present invention is illustrated. The present invention has the following elements.

A seat 20 is included.

A plurality of supporting frames 21 are rotatably installed to a periphery of the seat 20. One end of each supporting frame 21 is connected to the seat and other end of the supporting frame 21 is connected to a respective lamp body 22.

A stand tube 23 extends from an upper end of the seat 20. A lead 24 passes through an interior of the stand tube 23. One end of the lead 24 is connected to the seat 20 and another end of the lead 24 is connected to a retainer 25. A ring 26 encloses the stand tube 23. The ring 26 includes a connecting portion 261 and a clamping portion 262. The connecting portion 261 encloses around the stand tube 23. The clamping portion 262 is installed around the connecting portion 261. When the clamping portion 262 is rotated, the connecting portion 261 will be clamped to be fixed to the stand tube 23.

A plurality of adjusting wires 27 extend from a periphery of the stand tube 23. One end of each adjusting wire 27 is connected to the supporting frame 21 near the lamp body 22.

Thereby when moving the connecting portion 262 along the stand tube 23, the adjusting wire 27 will drive the supporting frame 21 to direct to different orientation. If the clamping portion 262 is locked, the connecting portion 261 will fix to the stand tube 23 so that the lamp body 22 is expanded or closed in a predetermined angle.

Figure 5:
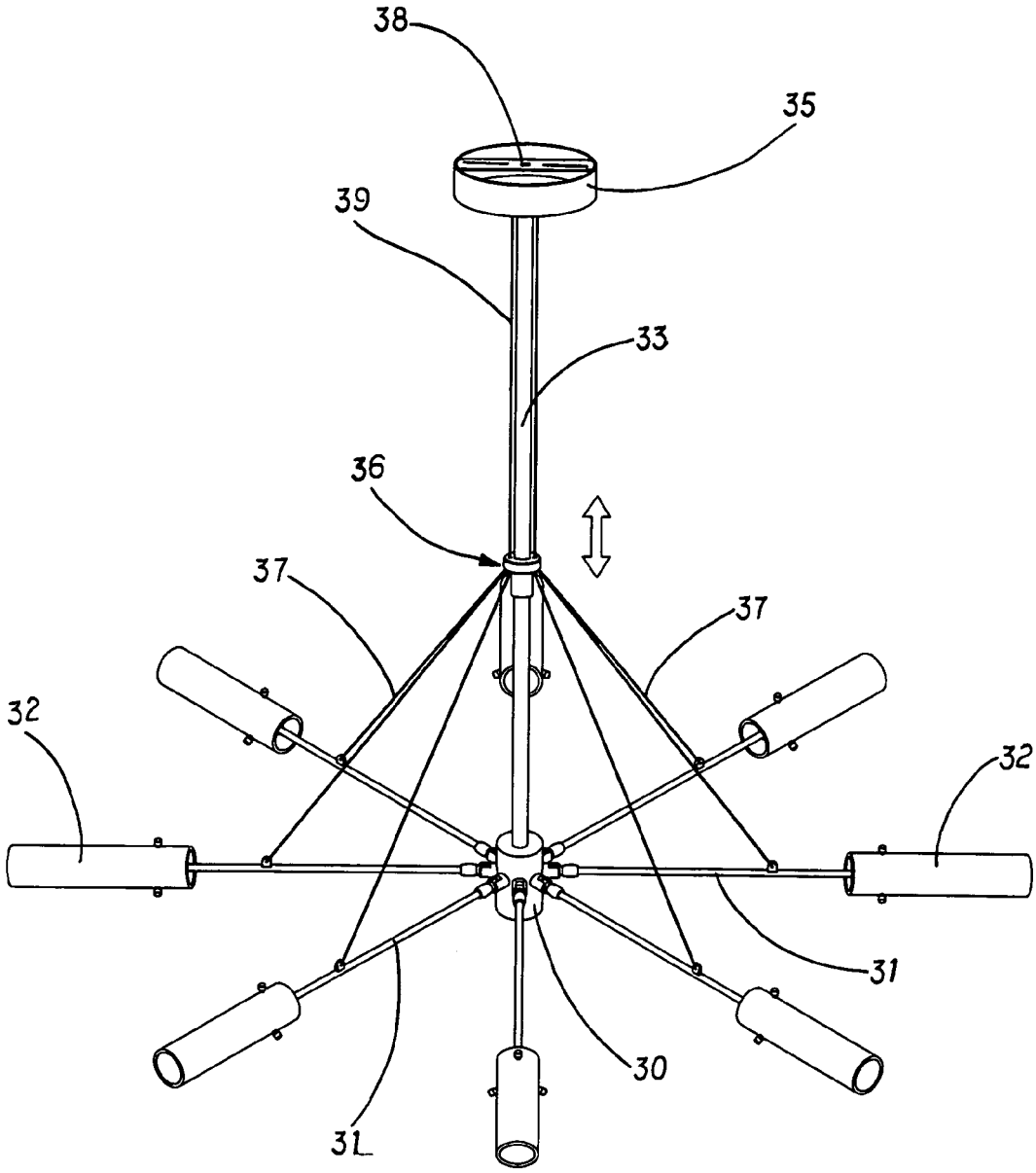
FIG. 5 is a perspective view about another embodiment of the present invention.
Figure 6:
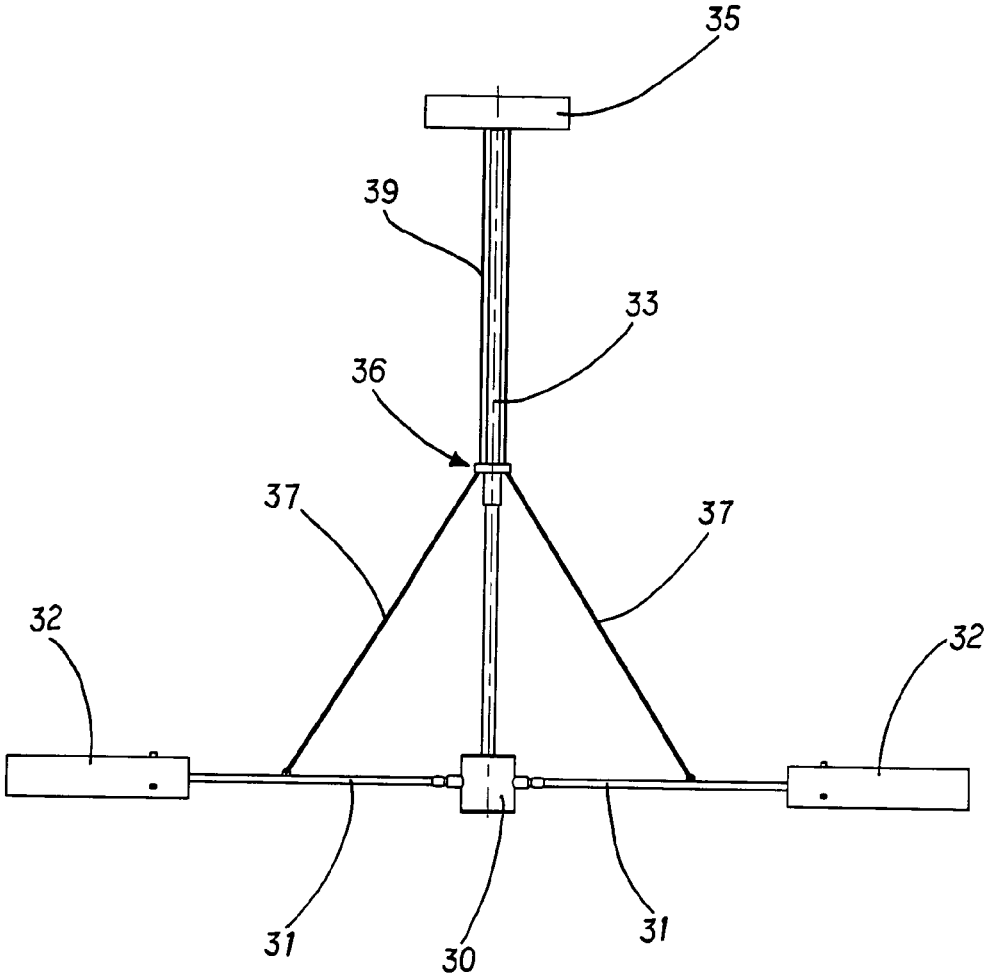
FIG. 6 is a plane view about another embodiment of the present invention.
Figure 7:
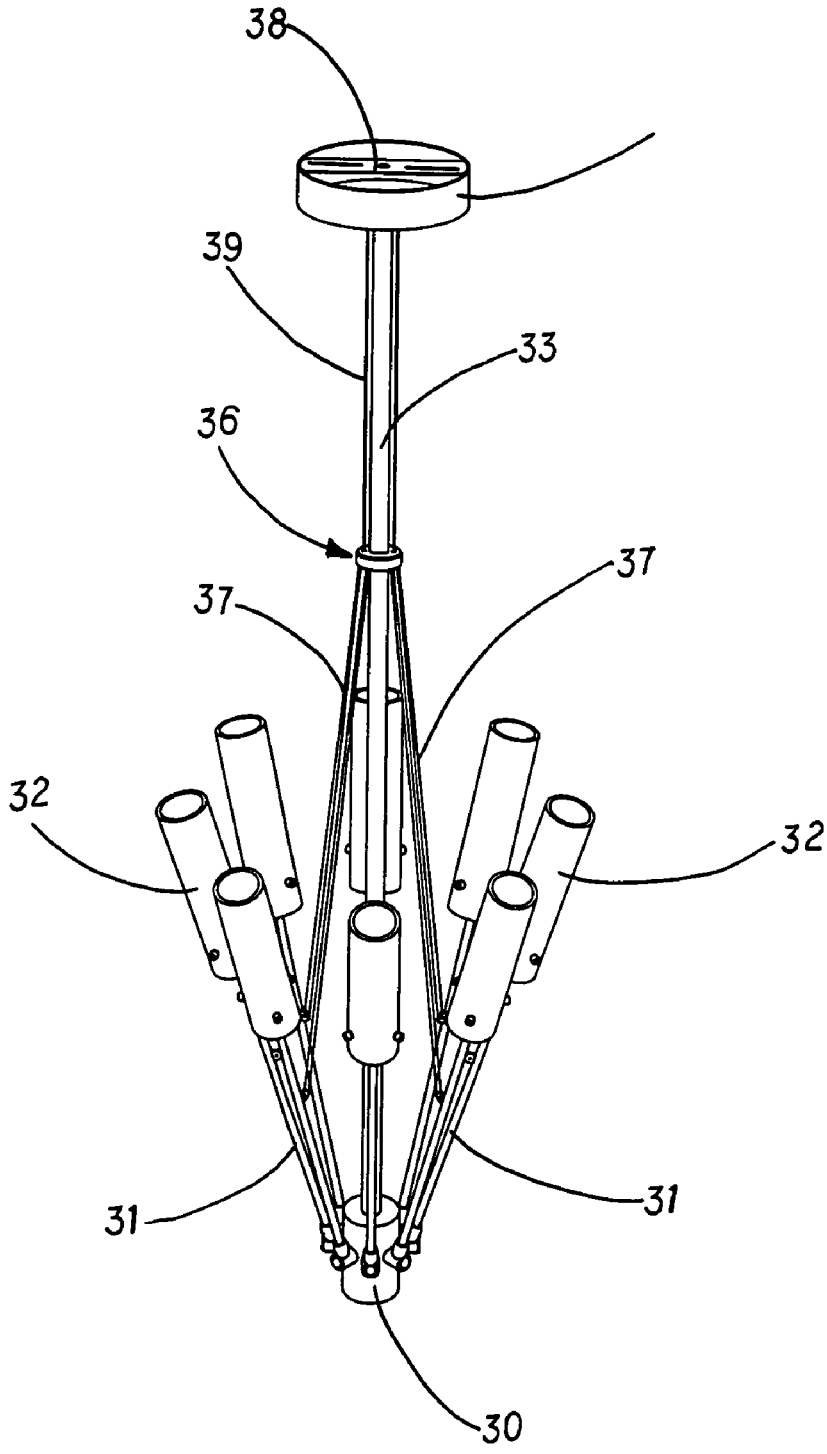
FIG. 7 is a perspective view about the use of the another embodiment of the present invention.

Referring to FIGS. 5 to 7, another embodiment of the present invention is illustrated. A periphery of the seat 30 has the plurality of supporting frames 31. One end of each supporting frame 31 is fixed with a respective lamp body 32. An upper end of the seat 30 is extended with a stand tube 33. A lead passes through the stand tube 33 and is then fixed to a retainer 35. A ring 36 encloses the stand tube 33. A motor 38 is installed to the retainer 35. At least one pull wire 39 is installed between a spin the motor 38 and the ring 36. By the driving of the motor, the pull wire 39 will be pulled upwards or released downwards and then the ring 36 moves along the stand tube 33. Then the adjusting wire 37 is driven to drive the supporting frames 31 to swing with respect to the stand tube 33. When the motor 38 stops, the ring 36 will be retained on the stand tube 33 so that the lamp bodies 33 are retained in a predetermined angle with respective to the stand tube 23.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An expanding structure of a lamp comprising:

a seat;

a plurality of supporting frames rotatably installed to a periphery of the seat; one end of each supporting frame being connected to the seat and other end of the supporting frame being connected to a respective lamp body;

a stand tube extending from an upper end of the seat; a lead passing through an interior of the stand tube; one end of the lead being connected to the seat and another end of the lead being connected to a retainer;

a plurality of adjusting wires extending from a periphery of the stand tube; one end of each adjusting wire being connected to the supporting frame near the lamp body; and wherein a ring encloses the stand tube; the ring includes a connecting portion and a clamping portion; the connecting portion encloses around the stand tube.

2. The expanding structure of a lamp as claimed in claim 1, wherein the clamping portion is installed around the connecting portion; when the clamping portion is rotated, the connecting portion will be clamped to be fixed to the stand tube.

3. The expanding structure of a lamp as claimed in claim 1, wherein a motor is installed to the retainer; at least one pull wire is installed between the motor and the ring; by the driving of the motor, the pull wire will be pulled upwards or released downwards and then the ring moves along the stand tube; then the adjusting wire connecting to the ring is driven to drive the supporting frames to swing with respect to the stand tube; when the motor stops, the ring will be retained on the stand tube so that the lamp bodies are retained in a predetermined angle with respective to the stand tube.

* * * * *